United States Patent [19]

Daussan et al.

[11] Patent Number: 4,660,808

[45] Date of Patent: Apr. 28, 1987

[54] HEAT-INSULATING CASTING TUBE FOR A METALLURGICAL VESSEL

[75] Inventors: Jean-Charles Daussan; Gérard Daussan; André Daussan, all of Metz, France

[73] Assignee: Daussan et Compagnie, Woippy, France

[21] Appl. No.: 737,052

[22] Filed: May 22, 1985

Related U.S. Application Data

[63] Continuation-in-part of Ser. No. 403,583, Nov. 26, 1980.

[51] Int. Cl.[4] ..... C21C 5/42

[52] U.S. Cl. ..... 266/236; 266/287

[58] Field of Search ..... 266/45, 236, 287, 272, 266/217, 271; 222/590, 591, 603, 606; 164/337, 335

[56] References Cited

U.S. PATENT DOCUMENTS 4,202,533 5/1980 Daussan et al. ..... 266/45
4,290,589 9/1981 Luhrsen et al. ..... 266/236

FOREIGN PATENT DOCUMENTS 10941 3/1968 Australia .
1493389 8/1967 France .
1551363 12/1968 France .
2333599 1/1979 France .
1215330 12/1970 United Kingdom .

*Primary Examiner*—L. Dewayne Rutledge
*Assistant Examiner*—S. Kastler
*Attorney, Agent, or Firm*—Young & Thompson

[57] ABSTRACT

A heat insulating casting tube is disposed between the outlet orifice of a first metallurgical vessel and a second metallurgical vessel. One end of the casting tube has a removable and substantially leaktight engagement about a casting nozzle or an adapter forming an extension of the nozzle of the first vessel. The casting tube is formed of a material sinterable under the action of the heat of the liquid metal as it flows in the tube. A ring of refractory material is disposed on the tube end engaged on and surrounding the lateral surface of the casting nozzle or adapter. The internal surface of this ring is shaped as the lateral surface of the casting nozzle or adapter and has a substantially leaktight engagement with that lateral surface. The height of the ring is such that its bottom edge is located above the zone in which the liquid metal which is poured into the tube would be liable to come into contact with the internal surface of the tube.

22 Claims, 15 Drawing Figures

HEAT-INSULATING CASTING TUBE FOR A METALLURGICAL VESSEL

The present invention is a continuation-in-part of patent application Ser. No. 403,583 filed 11-26-80 and relates to a heat-insulating casting tube which is intended to be placed between the outlet of a first metallurgical vessel such as a casting ladle and a second metallurgical vessel such as a tundish.

Casting tubes of known types are formed of different classes of materials.

In one class, the tube material is highly refractory such as silica, magnesia, zirconia, and graphite, alumina, carbon, subjected to isostatic pressing.

The materials just mentioned have the advantage of outstanding mechanical strength and thermal resistance, with the result that tubes fabricated from materials of this type have a very long service life.

In U.S. Pat. No. 1,215,330, for example, there was described a casting nozzle or tube arranged at the outlet of a casting ladle and formed of refractory material having an internal surface lined with refractory material which has a higher degree of hardness than the tube in order to afford resistance to the abrasion produced when the molten metal flows within the tube.

However, these materials are attended by a large number of disadvantages.

In the first place, by reason of their low heat-insulating capacity and their low thermal shock resistance and/or in order to prevent bursting of these tubes, it is necessary to subject them to a long and costly preheating operation prior to pouring of the molten metal in order to limit the danger of solidification of metal in contact with the tube wall since this would be liable to result in complete blockage of said tubes.

In the second place, casting tubes are of substantial weight and therefore difficult to handle as well as very costly to produce.

In order to overcome the above-mentioned disadvantages, the present Applicant has described in his French Pat. No. 2,333,599 a casting tube of heat-insulating material constituted by refractory inorganic particles (silica, alumina, magnesia) to which may be added either mineral or organic fibers, the particles and fibers being embedded in an organic or inorganic binder.

By reason of the outstanding heat-insulating properties of this material, tubes of this type do not entail any need for preheating. Furthermore, these tubes are of light weight, are therefore easy to handle and can be produced at low cost.

At the time of casting of steel in the liquid state, the organic constituents of the tube material undergo decomposition but the cohesion of the tube is maintained as a result of sintering of the inorganic particles under the action of the heat generated as the liquid metal flows within the tube.

Decomposition of the organic constituents and sintering of the inorganic particles endow the material with a porous structure which has a high heat-insulating capacity.

Tubes of this type are thus capable of affording resistance during a few casting operations.

The inventors have found that the service life of casting tubes could be extended by increasing the thickness of tube linings. However, they have observed that, after a certain period of use, the metal which flows within these tubes becomes charged with oxide inclusions. There was no apparent a priori explanation for this phenomenon. It has been found to occur even when the casting tube was fitted over the discharge nozzle of the top vessel in a leak-tight manner and when the lower end of the tube was immersed in the metal contained in the bottom vessel, which in principle prevented any penetration of air into the tube.

After having studied this problem, the inventors have accordingly put forward the following theory which has since proved to be correct.

At the upper end of a casting tube, namely at the end which is engaged on the nozzle of the casting ladle, the sintering process mentioned above does not take place since the tube material is not in direct contact with the jet of liquid metal at this point.

The tube material thus has a tendency to crumble rapidly and to become porous, with the result that, at the end of the casting operation, leak-tightness is no longer achieved between the casting tube and the ladle nozzle on which the tube end is engaged.

This defective leak-tightness then permits the admission of air into the tube as a result of a suction effect, thus giving rise to the formation of oxide inclusions within the metal. As a consequence, casting tubes of this type usually become unserviceable after only a few casting operations.

This drawback as observed by the inventors forms the conceptual basis of the present invention.

The aim of this invention is therefore to overcome this disadvantage by providing a casting tube which offers all the advantages of the tubes described in French Pat. No. 2,333,599 while having a considerably longer service life and remaining leak-tight at the end which is engaged over the outlet nozzle of the top vessel.

The casting tube contemplated by the invention is intended to be placed between the outlet orifice of a first metallurgical vessel and a second metallurgical vessel, one end of the casting tube being intended to be engaged in a removable and substantially leak-tight manner on the casting nozzle or on an adapter forming an extension of the nozzle of said first vessel. Said casting tube is formed of material consisting of inorganic particles to which fibers may be added and which are embedded in a binder. Said inorganic particles are sinterable under the action of the heat generated by the liquid metal as it flows within said tube.

In accordance with the invention, said casting tube is distinguished by the fact that the tube end to be engaged on the casting nozzle comprises a ring having an internal surface which is intended to come into direct contact with the external surface of the nozzle or with the adapter which forms an extension of said nozzle, said ring being of refractory material, the height of said ring being such that its bottom edge is located above the zone in which the molten metal which is poured into the tube is liable to come into contact with the internal surface of said tube.

Said ring of refractory material is therefore inserted in that portion of the tube end which is not sinterable under the action of the heat generated by the molten metal.

It will be understood that "refractory material" is a term used to designate material which affords resistance to the action of heat without decomposing and without undergoing any physical and chemical modification as molten metal flows within the tube. This refractory material can be of a conventional type such as silica, magnesia, alumina, zirconia, isostatically pressed graphite-alumina or carbon, or even a metal or alloy having a sufficiently high melting point.

By virtue of said refractory ring, leak-tightness between the tube and the casting nozzle remains excellent even after a number of successive casting operations.

Furthermore, said refractory ring does not have the effect of reducing the heat-insulating properties of the casting tube and does not entail any danger of solidification of the molten metal since said ring does not come into direct contact with the metal.

By reason of the fact that the end of the casting tube opposite to the casting nozzle is usually intended to dip into the liquid metal which is poured into the second metallurgical vessel, it is an advantage to ensure that the lower end of the casting tube is also fitted with a refractory ring.

Thus said lower end of the casting tube is not subject to erosion as a result of melting in contact with the liquid metal, the service life of said tube being thus extended even further.

Other features and advantages of the invention will be more apparent upon consideration of the following description and accompanying drawings, in which.

Figure 1:
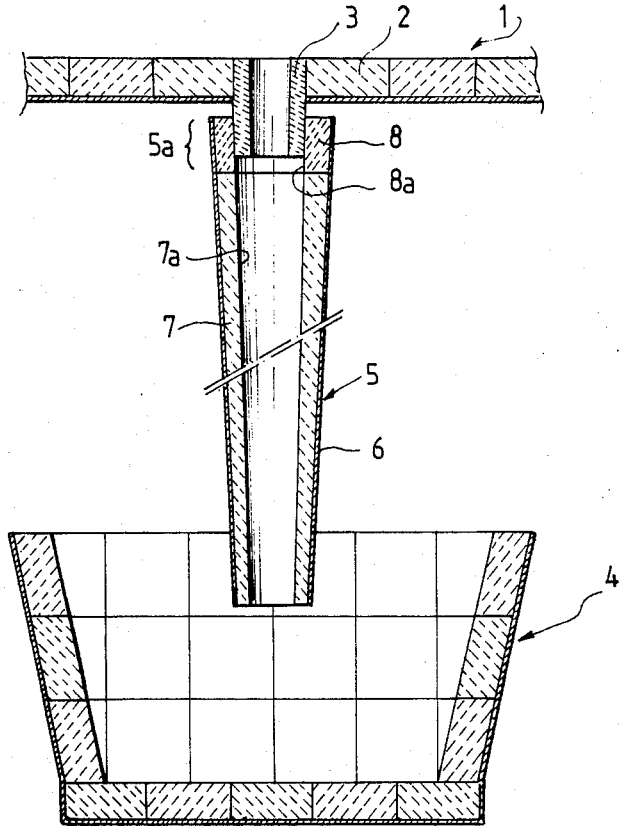
FIG. 1 is a fragmentary longitudinal sectional view showing the bottom of a casting ladle and a tundish placed beneath this latter, a casting tube in accordance with the invention being placed beneath the outlet nozzle of the casting ladle.

In the embodiment illustrated in FIG. 1, the bottom wall 2 of the casting ladle 1 is fitted with a casting nozzle 3 of highly refractory material such as silica, magnesia, refractory brick or zirconia.

Said casting nozzle 3 is placed above a tundish 4. The upper end 5*a* of a casting tube 5 is of slightly frusto-conical shape and removably engaged around said nozzle 3. The lower end of the casting tube is intended to be immersed in the molten metal which is fed into the tundish 4.

The means for removable attachment of the casting tube 5 to the nozzle 3 are not shown in the drawings. These means can be of the type described in French Pat. No. 2,333,599.

The casting tube 5 is composed of a protective outer sleeve 6 of sheet metal consisting for example of sheet steel and surrounding an inner wall 7 of lightweight heat-insulating material. This material is constituted by inorganic particles (silica, alumina, magnesia) to which are added inorganic fibers and which are embedded in an organic binder such as a synthetic resin or else an inorganic binder. The composition of this material is such that the inorganic particles are sintered under the action of the heat generated by the molten metal which is poured into the tube, thus making it possible to maintain cohesion as well as the heat-insulating properties of this material in spite of decomposition of the organic constituents of this latter.

The nature of the sunterable material of the tube lining can be either acid or basic.

One example of composition of acid nature is given hereunder:

| | |
|---|---|
| $SiO_2$ | 80 to 95% |
| CaO | 0 to 2% |
| $Al_2O_3$ | 0 to 2% |

with a binder such as:

| | |
|---|---|
| Phenol-formaldehyde resin and/or urea-formaldehyde resin and/or mineral binder: chromite, silicate, alumina phosphate, magnesia sulfate | 0.5 to 4% |
| Organic fibers | 0 to 3% |

The composition of basic nature can be as follows:

| | |
|---|---|
| MgO | 60 to 98% |
| CaO | 0 to 2% |
| $SiO_2$ | 0 to 20% |
| $Fe_2O_3$ | 0 to 4% |
| $Cr_2O_3$ | 0 to 20% |
| Binder (as above) | |
| Organic fibers | 0 to 3% |

In accordance with the invention, the end portion 5*a* of the tube 5 which is engaged on the casting nozzle 3 is provided with a ring 8 of refractory material, the internal surface 8*a* of said ring being in direct contact with the external surface of the casting nozzle 3. The height of said ring is such that its bottom edge 8*b* is located above the zone 15*b* (see FIG. 2) in which the metal 15 would be liable to come into contact with the ring 8, thus solidifying and causing serious disturbances.

The refractory material of the ring 8 is of the same nature as the material of the nozzle 3. Suitable materials which may be mentioned by way of example are silica, magnesia, refractory brick, isostatically pressed graphite-alumina or carbon or refractory clay. These materials all have the advantage of excellent mechanical strength and thermal resistance. Furthermore, they have very high dimensional stability, thereby ensuring a highly accurate fit of the ring 8 on the nozzle 3 throughout the duration of the casting operation.

The refractory material of the ring 8 can also be produced from grains of heat-resistant material such as silica, alumina, magnesia, which are bonded together by means of an inorganic binder endowed with resistance to the temperatures employed such as the phosphate or chrome binders, the silicate-base binders, magnesia cements, alumina cements, and other refractory cements. This material need not necessarily have a high degree of hardness and mechanical strength but should have sufficient dimensional stability to ensure that leak-tightness is maintained between the end of the casting tube and the nozzle.

Figure 2:
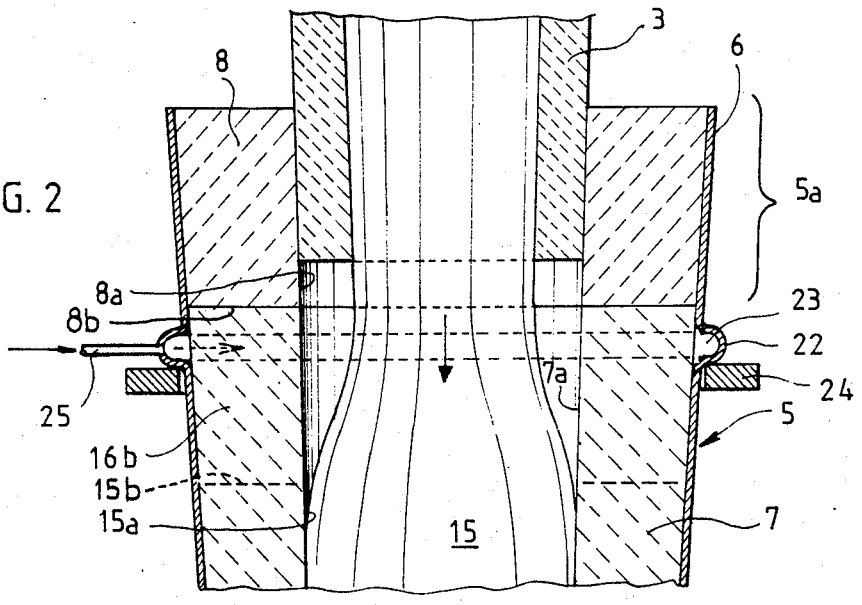
FIG. 2 is a fragmentary longitudinal sectional view to a large scale showing the upper end of the casting tube which is engaged on the casting nozzle as well as the jet of liquid metal which flows within said tube.

In the embodiment shown in FIGS. 1 and 2, the height of the refractory ring 8 is greater than the distance over which the end 5*a* of the tube 5 is engaged on the casting nozzle 3.

Furthermore, the wall thickness of the refractory ring 8 is substantially equal to the thickness of the wall 7 of the tube 5, with the result that the internal surface 8*a* and the external surface of the ring 8 are located substantially in the line of extension of the internal surface 7*a* and the external surface of the wall 7 of the casting tube 5.

The heat-insulating wall 7 is obtained by molding in a mold whose external wall is constituted by the sheet metal sleeve 6. This molding operation makes it possible to obtain direct adhesion of the material of the wall 7 to the sheet metal sleeve 6. Furthermore, the material of the wall 7 can also be joined directly to the refractory ring 8 at the time of molding. Nevertheless, it is also possible to provide other means for attaching the ring 8 to the sheet metal sleeve 6 and/or to the insulating wall 7. By way of example, such means can consist of screws, cement or an adhesive substance.

Figure 3:
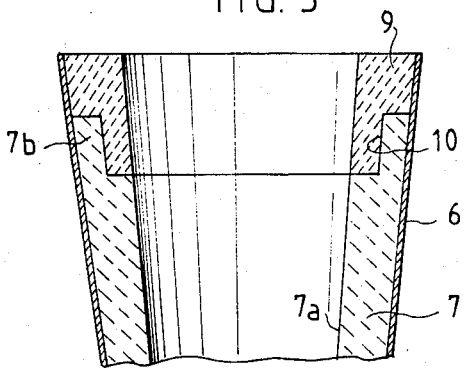
FIGS. 3 to 7 are fragmentary longitudinal sectional views showing a number of different alternative embodiments of the invention.

In the alternative embodiment shown in FIG. 3, the contact surface between the refractory ring 9 and the insulating material which constitutes the wall 7 of the casting tube has a stepped annular recess 10. Thus the ring 9 is forcibly fitted on the wall 7, thereby improving the mechanical joint obtained at the time of molding between said wall 7 and the ring 9. Moreover, said stepped annular recess 10 makes it possible to maintain a certain heat insulation within the portion 7*b* of the wall 7.

Figure 4:
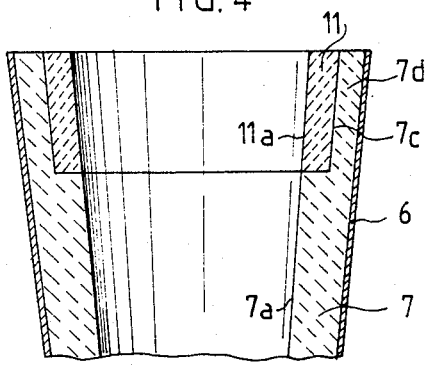

In the embodiment shown in FIG. 4, the wall of the ring 11 is of smaller thickness than the wall 7 of the tube, the internal surface ll*a* of said ring 11 being substantially coextensive with the internal surface 7*a* of the wall 7. Said ring 11 is thus fully sunk within an annular recess 7*c* formed at the end of the tube. This arrangement proves advantageous in regard to the strength of attachment of the ring 11 to the wall 7 and in regard to heat insulation at the level of the ring 11 in the portion 7*d*.

Figure 5:
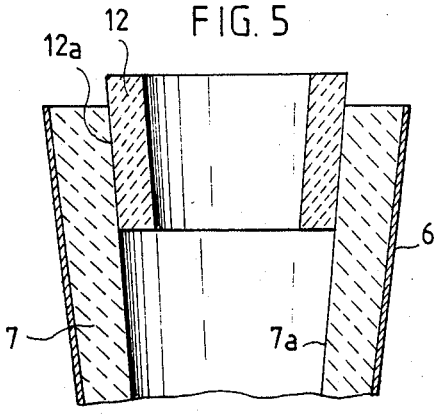

In the embodiment of FIG. 5, the refractory ring 12 has an internal diameter which is smaller than the internal diameter of the tube and the external surface 12*a* of said ring is coextensive with the internal surface 7*a* of the tube. Attachment of said ring 12 within the tube is achieved by the interengagement resulting from the conicity of the external surface 12*a* of the ring 12 and of the internal surface 7*a* of the tube. If necessary, this attachment may be reinforced by bonding or by other suitable mechanical means.

Figure 6:
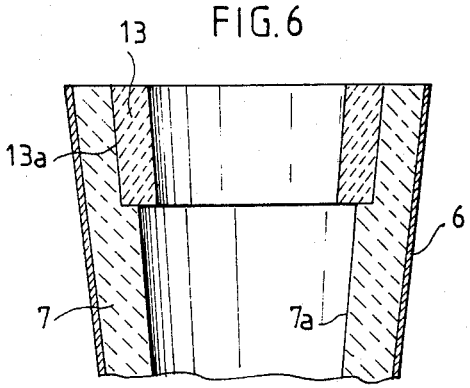

In the alternative embodiment of FIG. 6, the refractory ring 13 has an external diameter which is larger than the internal diameter of the tube and said ring is partially sunk within an annular recess 13*a* formed in the wall 7.

Figure 7:
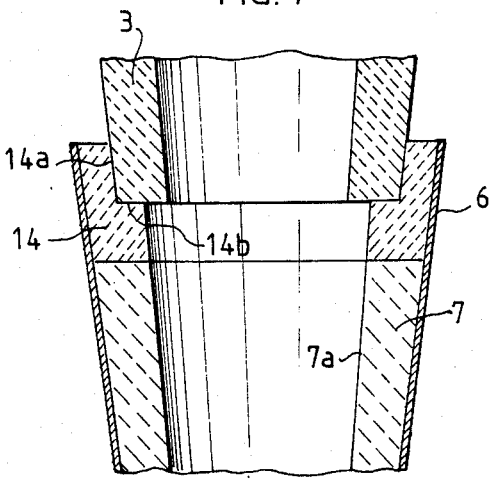

In the embodiment of FIG. 7, the upper portion of the refractory ring 14 is provided with an annular enlargement 14*a* for receiving the free end of the nozzle 3. This arrangement achieves enhanced leak-tightness between the upper portion of the tube and the nozzle 3. Moreover, the annular shoulder 14*b* constitutes an abutment which ensures perfect axial positioning of the tube with respect to the nozzle while preventing any danger of relative jamming between the nozzle and the ring 14.

The embodiments described in the foregoing share a number of technical advantages as will now be explained.

In the first place, taking into account the mechanical properties of the refractory material constituting the rings 8, 9, 11, 12, 13 and 14, it is possible to obtain a highly accurate fit between the internal surface of said rings and the external surface of the nozzle 3.

Furthermore, taking into account the high abrasion resistance of said rings, perfect leak-tightness between these latter and the nozzle 3 is maintained even after the tubes have been placed on the nozzle a number of times in succession.

During the casting operation, the rings in accordance with the invention do not undergo any chemical transformation. Furthermore, in view of the fact that said rings are usually formed of a refractory material of the same nature as the material of the nozzle 3, said rings are subjected to thermal expansion which is comparable with that of the nozzle 3, with the result that no clearance is formed between said rings and the nozzle. The joint therefore remains completely leak-tight, thereby removing any possibility of introduction of air within the tube and any danger of oxidation of the liquid metal.

At the time of casting, the diameter of the jet of liquid metal 15 (as shown in FIG. 2) which is discharged from the nozzle 3 is constricted by virtue of the progressive reduction in internal diameter of the tube 5 and this results in an enlargement of the jet 15 in the upper portion 15*a* of this latter. The contact between the jet of liquid metal 15 and the wall 7 of the tube 5 has the effect of subjecting the wall material to a sintering action which serves to maintain mechanical cohesion of said material during the casting operation. However, this sintering process does not take place within the zone 16*b* of the wall 7 which is located in proximity to the nozzle 3 since this latter is not in direct contact with the jet of metal 15, as can be seen in FIG. 2. Said zone 16*b* thus has a tendency to crumble as a result of decomposition of the binder under the action of heat. It is thus apparent that, if no provision were made for a refractory ring 8, complete disintegration of the zone 16*b* of the wall 7 of the tube 5 would take place and would necessarily result in a substantial annular clearance between the upper portion of the wall 7 of the tube and the nozzle 3. This clearance would thus permit admission of air into the tube and therefore cause oxidation of the liquid metal, with the result that said tube would become unserviceable for any subsequent casting operation.

In the case of the invention, decomposition of the zone 16*b* of the wall 7 of the tube 5 is not attended by any disadvantage since the ring 8 ensures perfect leak-tightness between the nozzle 3 and the tube 5 both at the beginning and at the end of the casting operation.

It is also worthy of note that, on completion of the casting operation, that portion of the wall 7 which is located beneath the zone 16*b* remains in a state of perfect cohesion and retains a high heat-insulating capacity as a result of the porous structure obtained by sintering.

Thus the tube in accordance with the invention remains in a serviceable state for a large number of successive casting operations.

When the end of the tube 5 is intended to dip into the molten metal which is poured into the tundish 4, the outer sheet-metal sleeve 6 melts in contact with the liquid metal and the same applies to the material of the tube wall 7. This may also make it impossible to re-use the casting tube 5.

Figure 8:
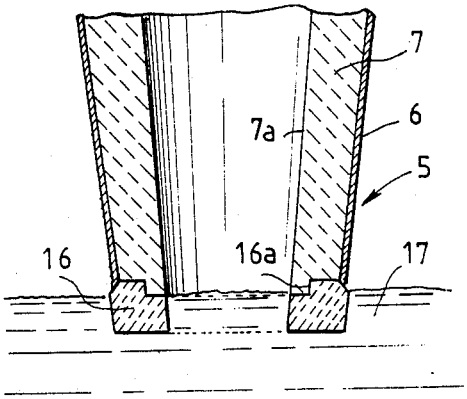
FIG. 8 is a longitudinal sectional view of the lower end of an advantageous embodiment of the casting tube in accordance with the invention, said lower end being immersed in the liquid metal contained in the tundish.

In order to overcome this problem, it proves advantageous to fit the free end of the tube 5 with another ring 16 of refractory material which affords resistance to the contact of the molten metal 17 as indicated in FIG. 8.

The height of said ring 16 corresponds at least to the depth of immersion of the end portion of the casting tube in the metal 17 contained in the tundish.

In the embodiment which is illustrated, the thickness of the wall of said ring 16 is substantially equal to the thickness of the tube wall 7 plus the thickness of the sheet metal sleeve 6. Said sleeve 6 covers the entire surface of the tube wall 7 and stops at the level of the ring 16 in order to prevent any direct contact with the molten metal 17.

The ring 16 can be joined to the wall 7 of the tube 5 at the time of molding of said wall as in the case of the upper rings illustrated in FIGS. 1 to 7. Attachment of said ring 16 to the wall 7 is improved when the contact surface of said attachment has a stepped annular recess 16*a* as shown in FIG. 8.

By means of the refractory ring 16, the end portion of the tube 5 is not liable to sustain damage in contact with the molten metal 17, with the result that said tube can be re-used for a large number of successive casting operations.

As will be readily understood, the invention is not limited to the examples which have been described in the foregoing and many modifications may be made in these examples without thereby departing either from the scope or the spirit of the invention.

Figure 9:
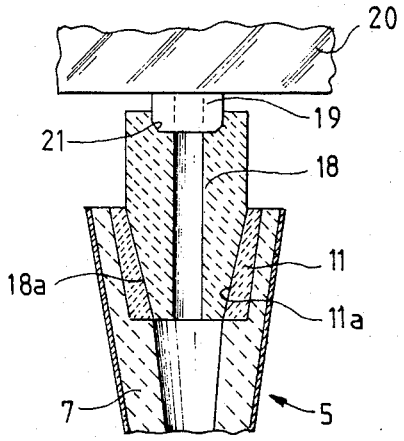
FIG. 9 is a longitudinal sectional view of a casting tube engaged on an adapter for a slide-valve nozzle.

The invention may thus apply to the case in which an adapter 18 is interposed between a short nozzle 19 and the casting tube 5 as shown in FIG. 9. Said nozzle 19 forms part of the slide-valve 20 of an opening and closing system designated as the "slide-valve nozzle" of the pouring outlet of a casting ladle. In this case, the top portion of the adapter 18 of refractory material is provided with an annular cavity 21 which receives the end of the nozzle 19. The frusto-conical lower end 18*a* of the adapter 18 is engaged in leak-tight manner within the internal surface 11*a* of a refractory ring 11.

In this embodiment, the refractory ring 11 performs the same function both with respect to the adapter 18 and with respect to the casting nozzle 3 in the case of the preceding embodiments.

The aforementioned adapter 18 is necessary in all cases in which the casting nozzle is too short. In some designs, said adapter 18 can also perform the function of a casing for collecting the gases which are intended to be blown into the liquid steel.

Furthermore, the shape and mode of attachment of the upper refractory ring can be modified in order to permit adaptation to all the possible shapes of nozzles.

Similarly, the shape and mode of attachment of the lower ring 16 can be modified, preferably on condition that the liquid metal contained in the tundish does not come into direct contact with the insulating wall 7.

For convenience of assembly and prevention of damage to the lower ring during transportation, said ring can be incorporated in the sheet metal sleeve 6. The molten steel which comes into contact with the sleeve 6 has the effect of melting this latter over the entire depth of immersion in the steel bath. In consequence, it is an advantage to incorporate said ring at a sufficient height in the external sleeve 6 to ensure that the bottom portion of said sleeve which has not melted thus remains capable of maintaining the ring in position.

As will be readily apparent, the casting tube in accordance with the invention can be employed for metallurgical vessels other than casting ladles and tundishes.

Furthermore, it is an advantage to provide the outer sheet-metal sleeve 6 of the casting tube 5 with an outwardly projecting hollow annular bead 22 (as shown in FIG. 2) which defines an empty annular space 23 between the sleeve and the heat-insulating internal wall 7. By means of a support 24, said annular bead 22 serves to maintain the tube 5 applied against the external surface of the nozzle 3.

In the embodiment shown in FIG. 2, the empty annular space 23 communicates with a horizontal pipe 25 which is connected to a source of non-oxidizing or inert gas such as argon. Said bead 22 is preferably formed opposite to the non-sinterable zone 16*b* which is adjacent to the ring 8 of the wall 7 and which remains porous. Thus the gas introduced into the annular space 23 is uniformly diffused through the wall 7 around the entire periphery of this latter and penetrates into the interior of the tube 7 while providing the molten metal with an additional protection against oxidation.

Figure 10:
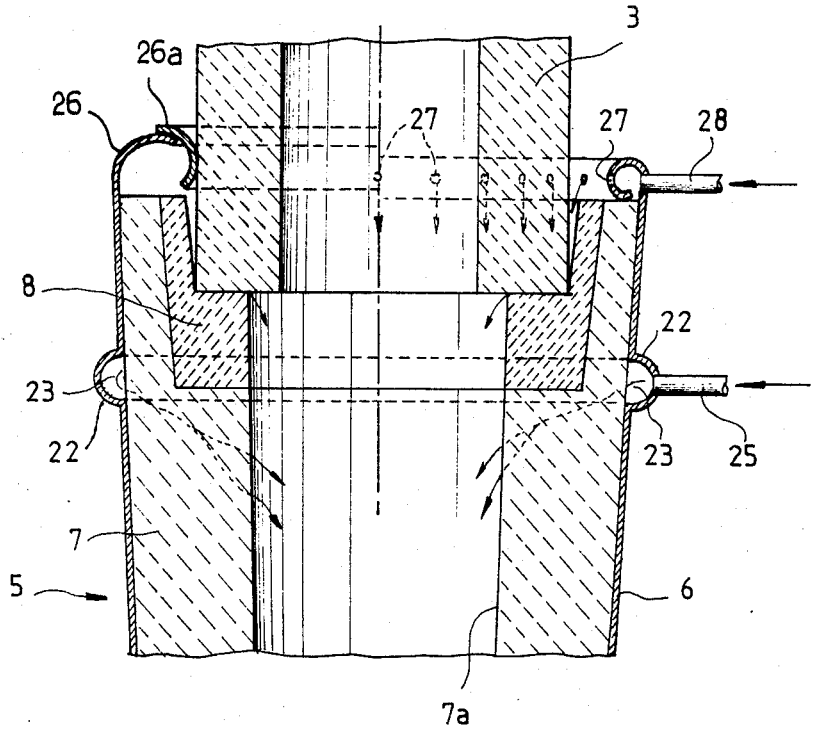
FIGS. 10 and 11 are longitudinal sectional views of other alternative embodiments.

In the embodiment of FIG. 10, the outer sheet-metal sleeve 6 is provided at the top with a second hollow annular bead constituted by a tube or rolled-in edge 26 of the sheet metal sleeve. Said rolled-in edge or said tube 26 is applied against the adjacent end of the insulating wall 7 and can also have a point of contact with the outer wall of ceramic fiber either directly or with interposition of a seal 26*a*. Said rolled-in edge or said tube 26 defines an annular duct which communicates with a pipe 28 for the admission of an inert gas such as argon. Said rolled-in edge 26 is provided with a series of openings 27 directed radially towards the axis of the tube 5.

The advantage of this arrangement is as follows: by reason of the fact that the ring 8 is of refractory material having a high degree of hardness, said material is liable to flake when it is placed too suddenly in contact with the high-hardness refractory material of the same type as the nozzle 3 or the nozzle extension 18. The flakes thus formed are liable to give rise to admissions of air into the interior of the casting tube 5 as a result of suction (Venturi effect). The rolled-in edge or the tube 26 serves to produce jets of argon or any other inert gas around the entire periphery of the nozzle 3, thus preventing any penetration of air into the interior of the tube 5.

Figure 11:
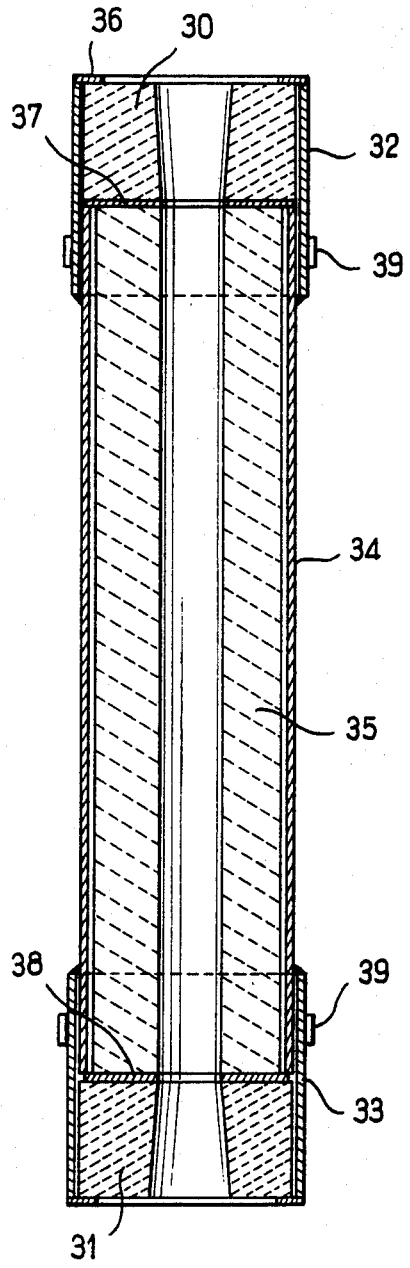

In the embodiment of FIG. 11, the casting tube is preferably entirely cylindrical and is provided at its opposite ends with two refractory rings 30, 31 which are identical or at least have two similar conical inlets, with the result that either of these rings can be mounted on the casting nozzle or intended to dip into the molten metal of the bottom vessel. This arrangement simplifies the construction and the operations which involve handling of the casting tube.

In this embodiment, each ring 30 or 31 is secured to the tube by means of a sheet-metal sleeve 32, 33 and this latter is welded to the sheet-metal cladding tube 34 which covers the internal lining 35. The sheet-metal sleeve 32, 33 can have a flanged end 36 which serves to hold the ring 30 or 31 in position. A layer 37, 38 of refractory cement can be interposed between the ring 30 or 31 and the internal lining 35 so as to provide a bond between said rings 30, 31 and the opposite ends of the lining 35. The sheet-metal sleeves 32, 33 can be provided in addition with a sheet-metal ring 39 which is welded around the periphery of each sleeve and performs the same function as that of the annular bead 22 of FIG. 10.

The refractory rings 30 and 31 can be fabricated in one case from a composition of basic inorganic material and in the other case from a composition of acid inorganic material in which a refractory inorganic binding agent is incorporated. Thus the casting tube will have a universal character and will prove suitable for use irrespective of the basic or acid nature of the slag which is present at the surface of the molten metal bath contained in the bottom vessel.

Figure 12:
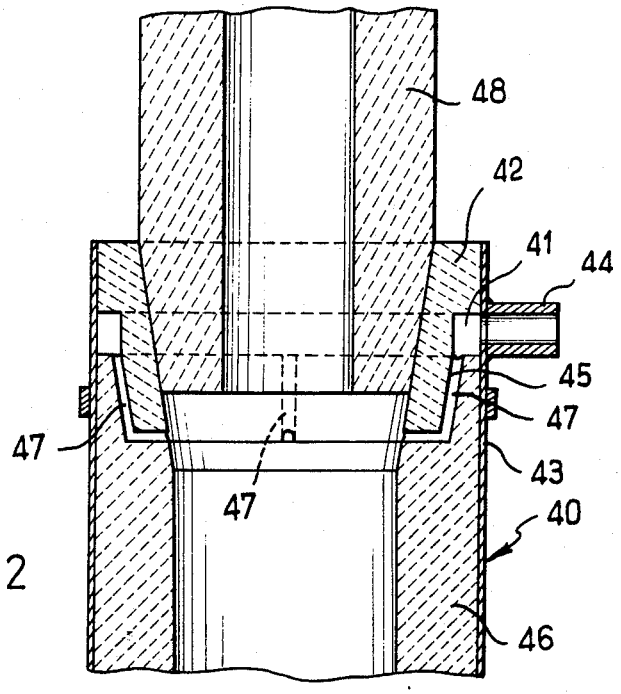
FIG. 12 is a longitudinal sectional view showing an alternative embodiment for the supply and admission of inert gas into the casting tube.

In the embodiment of FIGS. 12 to 15, there are shown a number of alternative methods for feeding inert gas into the casting tube. In the case of FIG. 12, an annular channel 41 is formed around the refractory ring 42, this channel being closed laterally by the outer sheet-metal jacket 43 of the casting tube 40. An inert-gas feed-pipe 44 opens into said channel 41. At the interface 45 between the refractory ring 42 and the internal lining 46 of the tube 40 are formed ducts 47 which communicate with the annular channel 41 and open into the interior of the tube 40. Said ducts 47 can be formed either in the refractory ring 42 or in the material of the lining 46.

Figure 13:
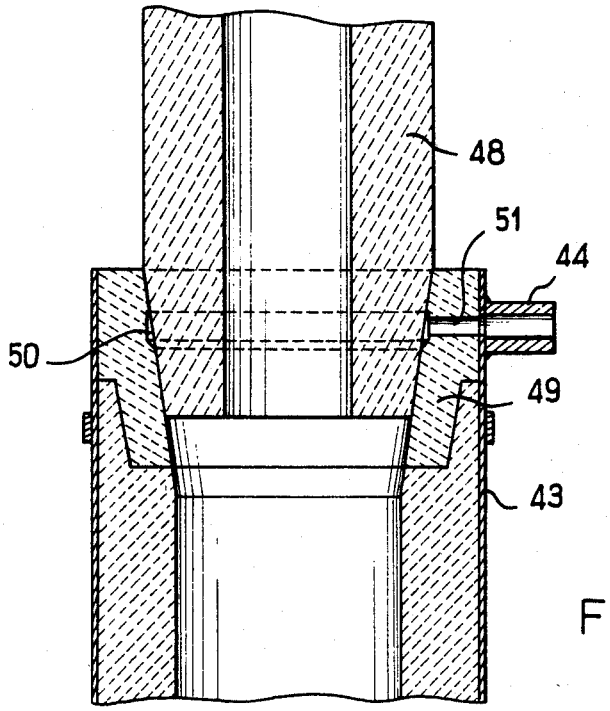
FIGS. 13 to 15 are views which are similar to FIG. 12 and relate to further alternative embodiments.
Figure 15:
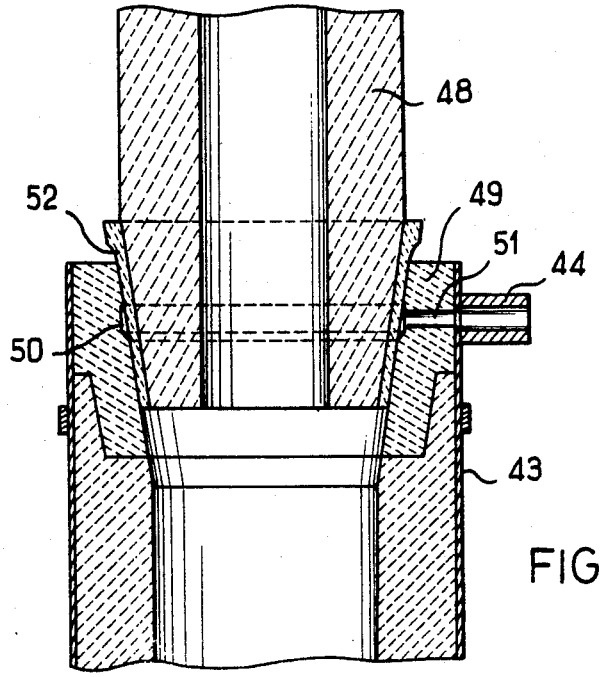

In the embodiment shown in FIG. 13, an annular channel 50 is formed between the end of the nozzle 48 on which the refractory ring 49 is engaged and said ring. Said channel 50 is cut in the refractory material of said ring and communicates with an inert-gas feed-pipe 44 via a duct 51 which extends through the refractory ring 49. The embodiment illustrated in FIG. 15 is similar to FIG. 13 except for the fact that a seal 52 of asbestos, glass, slag, or ceramic fibers is interposed between the refractory ring 49 and the end of the nozzle 48.

Figure 14:
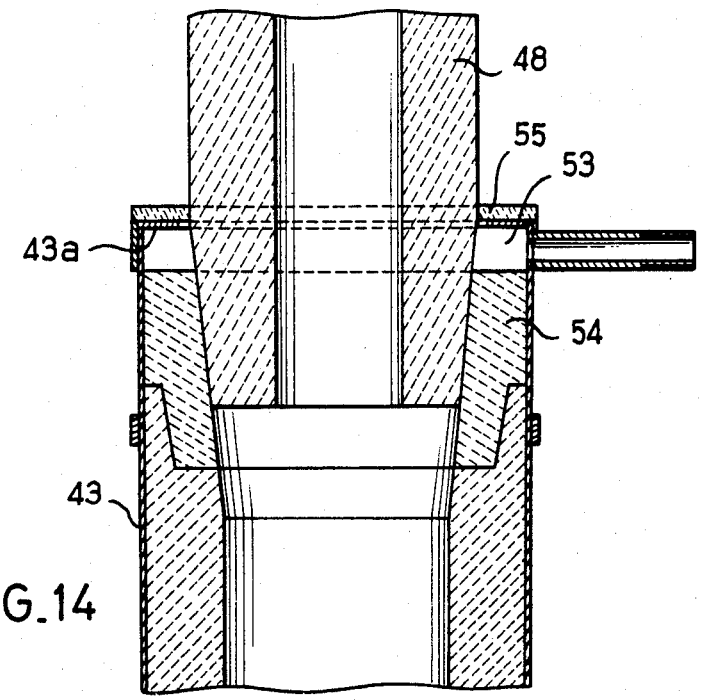

In the embodiment of FIG. 14, an annular channel 53 is formed above the refractory ring 54, said channel 53 being delimited on the one hand by the lateral surface of the nozzle 48 and on the other hand by a flange 43*a* of the outer sheet-metal jacket 43 of the casting tube.

The inert-gas feed-pipe 55 opens into said annular channel 53. The flange 43*a* is covered by a seal 55 of ceramic fibers.

All the arrangements provided in accordance with FIGS. 12 to 15 make it possible to forestall any danger of introduction of air into the joint between the nozzle and the casting tube.

What is claimed is:

1. In a combination comprising a heat-insulating casting tube (5) disposed between the outlet orifice of a first metallugical vessel (1) and a second metallurgical vessel (4), one end (5*a*) of the casting tube having a removable and substantially leaktight engagement about a casting nozzle (3) or about an adapter (18) forming an extension of a nozzle (19) of said first vessel (1) so as to restrict the flow of air between the casting tube and the nozzle or adpter, said casting tube being formed of material (7) comprising inorganic particles which are embedded in an organic binder, said inorganic particles being sinterable under the action of the heat of the liquid metal as it flows within said tube; the improvement comprising a ring (8, 9, 11, 12, 13, 14, 30) of refractory material on said tube end (5*a*) engaged on and surrounding the lateral surface of the casting nozzle (3) or adapter (18), the internal surface of the said ring being shaped as the lateral surface of said casting nozzle (3) or adapter (18) and having a substantially leaktight engagement with said lateral surface, the height of said ring being such that its bottom edge (8*b*) is located above the zone in which the liquid metal (15) which is poured into the tube would be liable to come into contact with the internal surface of said tube, and another refractory ring on the end of the tube which is opposite the first-mentioned ring.

2. A combination according to claim 1, wherein the height of the ring (8, 9, 11, 12, 13, 14) of refractory material is at least equal to the distance over which said end (5*a*) of the casting tubc (5) is intended to be engaged on said casting nozzle.

3. A combination tube according to claim 1, the tube being formed by molding, wherein the ring (8, 9, 11, 12, 13, 14) of refractory material is attached to the material of the wall (7) of the tube (5) during the molding of said wall.

4. A combination according to claim 1, wherein the wall thickness of the refractory ring (8, 9, 11) is substantially equal to the wall thickness of the wall (7), the internal and external surfaces of the ring being substantially coextensive with the internal and external surfaces of the tube wall (7).

5. A combination tube according to claim 4, wherein the contact surface between the refractory ring (9) and the tube wall (7) has at least one stepped annular recess (10).

6. A combination according to claim 1, wherein the thickness of the refractory ring (11) is smaller than the thickness of the tube wall (7), the internal surface (ll*a*) of said ring being substantially coextensive with the internal surface (7*a*) of said tube.

7. A combination according to claim 1, wherein the internal diameter of the refractory ring (12, 13) is smaller than the internal diameter of said tube.

8. A combination according to claim 7, wherein the external surface (12*a*) of the ring (12) is coextensive with the internal surface (7*a*) of said tube.

9. A combination according to claim 7, wherein the external diameter of the refractory ring (13) is greater than the internal diameter of said tube and wherein said ring is partially sunk within an annular recess (13*a*) formed in the tube wall (7).

10. A combination tube according to claim 1, wherein the top portion of the internal surface of the refractory ring (14) is provided with an annular enlargement (14a) for receiving the free end of the casting nozzle (3).

11. A combination according to claim 1, wherein the thickness of the ring (16) is substantially equal to the thickness of the wall (7) of the tube (5).

12. A combination according to claim 1 and comprising a protective outer sheet-metal sleeve, wherein said sheet-metal sleeve is provided with an outwardly-projecting hollow annular bead (22) defining an empty annular space (23) between said sheet-metal sleeve and the internal tube wall (7), said space being intended to communicate with a pipe (25) connected to a source of non-oxidizing or inert gas.

13. A combination according to claim 12, wherein said hollow annular bead (22) is adjacent to the refractory ring (8).

14. A combination according to claim 12, wherein the outer sheet-metal sleeve (6) is provided at the top with a hollow annular bead constituted by a rolled-in edge (27) of the sheet-metal sleeve, said rolled-in edge being applied against the adjacent end of the tube wall (7) and intended to define within the interior of said rolled-in edge an annular duct which communicates with a pipe

(28) for the admission of inert gas, said rolled-in edge (26) being provided with a series of openings (27) directed radially towards the axis of said casting tube.

15. A combination according to claim 1, wherein said tube is frusto-conical.

16. A combination according to claim 1, wherein said tube is entirely cylindrical.

17. A combination according to claim 16, wherein the ends of said tube are fitted with two identical rings (30, 31).

18. A combination according to claim 17, wherein one of the rings is of basic refractory inorganic material whilst the other ring is of acid refactory inorganic material, a refractory inorganic binding agent being incorporated in said inorganic material.

19. A combination according to claim 1, wherein an annular channel (41) is formed around the refractory ring (42), said channel being closed laterally by the outer sheet-metal jacket (43) of the casting tube (40), wherein an inert-gas feed-pipe (44) opens into said channel (41), and wherein ducts (47) formed at the interface (45) between the refractory ring (42) and the internal lining (46) of the casting tube (40) are adapted to communicate with the annular channel (41) and open into the interior of said casting tube (40).

20. A combination according to claim 1, wherein an annular channel (50) is formed between that end of the nozzle (48) on which the refactory ring (49) is engaged and said ring, said channel (50) being cut in the refractory material of said ring and adapted to communicate with an inert-gas feed-pipe (44) via a duct (51) which extends through the refractory ring (49).

21. A combination according to claim 1, wherein an annular channel (53) is formed above the refractory ring (54), said channel (53) being delimited on the one hand by the lateral surface of the nozzle (48) and on the other hand by a flange (43*a*) of the outer sheet-metal jacket (43) of the casting tube, and wherein the inert-gas feed-pipe (55) opens into said channel (53), the flange (43*a*) being covered by a seal (55) of ceramic fibers.

22. A combination according to claim 1, wherein an annular channel (50) is formed between that end of the nozzle (48) on which the refactory ring (49) is engaged and said ring, said channel (50) being cut in the refactory material of said ring and adapted to communicate with an inert-gas feed-pipe (44) via a duct (51) which extends through the refactory ring (49), a seal (52) of asbestos, glass, slag or ceramic fibers being interposed between the refractory ring (49) and the end of the nozzle (48).

* * * * *